United States Patent [19]

Drimmer et al.

[11] 4,185,551

[45] Jan. 29, 1980

[54] UNDERWATER CABLE CUTTING DEVICE

[75] Inventors: Bernard E. Drimmer, Brentwood; Everett L. Moffett, Laurel, both of Md.

[73] Assignee: The United States of America as represented by the Secretary of the Navy, Washington, D.C.

[21] Appl. No.: 260,292

[22] Filed: Dec. 6, 1951

[51] Int. Cl.[2] ..... F42B 22/42

[52] U.S. Cl. ..... 102/15

[58] Field of Search ..... 102/10, 56, 24 HC

[56] References Cited

U.S. PATENT DOCUMENTS

| | | | |
|---|---|---|---|
| 1,067,773 | 7/1913 | Steinmetz | 102/9 |
| 1,304,549 | 5/1919 | DuPont | 102/15 |
| 1,372,617 | 3/1921 | Fullinwider | 102/16 |
| 2,407,093 | 9/1946 | Mohanpt | 102/56 |
| 2,415,814 | 2/1947 | Davies et al. | 102/56 |
| 2,506,836 | 5/1950 | Kaltenberger | 102/24 HC |

FOREIGN PATENT DOCUMENTS

| | | | |
|---|---|---|---|
| 846738 | 6/1939 | France | 102/9 |

*Primary Examiner*—Charles T. Jordan
*Attorney, Agent, or Firm*—R. S. Sciascia; A. L. Branning

EXEMPLARY CLAIM

1. A sweep wire destroying device of the character disclosed comprising a buoyant member adapted to cause the device to float within a body of water, means including a cable for mooring the device within the water, a movable annular member disposed about said cable for engagement by a sweep wire, a tubular member on said device for slideably supporting said annular member, a shaped charge disposed within the device in adjacency to said annular member, means including a liner forming a toroidal air chamber abutting the lower surface of said charge, means including a primer controlled by said annular member for firing said shaped charge when the annular member engaged by said sweep wire, and means including an inert mass arranged within said charge intermediate the primer and said liner for initially controlling the application of force of the explosion in such manner that the explosive wave is applied uniformly and symmetrically to the toroidal surface of said liner as the shaped charge is fired thereby to sever said sweep wire.

7 Claims, 7 Drawing Figures

UNDERWATER CABLE CUTTING DEVICE

This invention relates to a device for destroying a sweep wire or cable of the type generally employed for sweeping a mine field clear of mines. More specifically, the invention relates to an anti-sweep device of the submersible type adapted to be moored by a suitable length of cable in a predetermined position beneath the surface of a body of water within the path of travel of a sweep wire in which a special shaped explosive charge contained within the device is exploded in response to the engagement of the device by a sweep wire, the shaped charge being sufficiently large and formed in such a manner as to provide a shaped jet about the sweep wire when detonated whereupon the cable is severed in response thereto.

Heretofore, when sweeping mine fields comprising anchored or moored types of mines, it has been the general practice to employ a wire, cable or chain, hereinafter referred to as a sweep wire, towed through the water by either one or two vessels, as the case may be, the sweep wire being maintained at a predetermined depth of submergence within the body of water by otter boards, depressors or similar devices. The sweep wire is usually composed of a plurality of steel wires woven together to form a cable and having projections or protuberances thereon adapted to engage the mooring cable or the antenna of a mine and sever the same as the vessel or vessels continue their onward movement. In other types of sweep wires the engagement of the sweep wire with the mooring cable or antenna of the mine, as the case may be, causes the mooring cable or antenna to be severed by the action of certain shearing devices carried by or included within the sweep wire or by reason of certain cutting edges attached thereto which slice or shear the mooring cable or antenna of the mine as the sweep wire engages the same.

The present invention contemplates the provision of new and improved means for effectively destroying a sweep wire, whereby the sweeping operations of the enemy is greatly impeded, and thus the enemy is unable to sweep a mine field as effectively as heretofore.

The device of the present invention comprises a casing or hermetically sealed chamber preferably having a streamlined float or a buoyant casing attached thereto in which a positive degree of buoyancy is provided sufficient to maintain the device at a predetermined distance from the bed of a body of water within which the device is planted. The device is secured to one end of a mooring cable having the other end thereof attached to a suitable anchor whereby the device is adapted to be moored to the bed of a body of water and floated at a predetermined depth of submersion beneath the surface of the water. The device is provided with a releasable firing pin adapted to explode an explosive shaped charge, when a cylindrical member movably secured to the device at the lower end thereof and moved by the sweep wire as the sweep wire engages an annular member thereon and moves the aforesaid members in a direction away from the anchor.

When this occurs, the firing pin is released, thereby firing a percussion cap secured to a detonating device arranged within the path of travel of the firing pin, whereupon the shaped charge is exploded in proximity to the sweep wire, and thus a circular jet of sufficient force is directed against the sweep wire to cause the cutting thereof.

An object of the present invention is the provision of a new and improved device for destroying a sweep wire in which a shaped charge is employed for cutting the sweep wire upon detonation of the charge.

Another of the objects is the provision of means for firing a shaped charge adjacent the sweep wire of a mine sweeping vessel in response to the engagement of the device by the sweep wire.

Another object is to provide a new and improved firing device adapted to be armed by the pressure of the water within which the device is submerged and having detonation wave shaping means to effect the cutting of the sweep wire, when the sweep wire engages the device.

Still another object is the provision of a new and improved device for destroying a sweep wire in which an inert barrier is arranged within an explosive charge to shape the detonation wave thereof as the charge is fired thereby to render the device effective for cutting the sweep wire and in which the means employed for detonating the device is brought into operative relation with an explosive device as the device is armed.

A futher object is the provision of a new and improved device for destroying a sweep wire in which an explosive charge having an annular recess in the form of a half of a toroid therein and adapted to produce a jet of sufficient intensity to sever the sweep wire as the charge is detonated and in which means controlled by the pressure of the water are employed for arming the device.

Other objects and many of the attendant advantages of this invention will be readily appreciated as the same becomes better understood by reference to the following detailed description when considered in connection with the accompanying drawings wherein.

Figure 1:
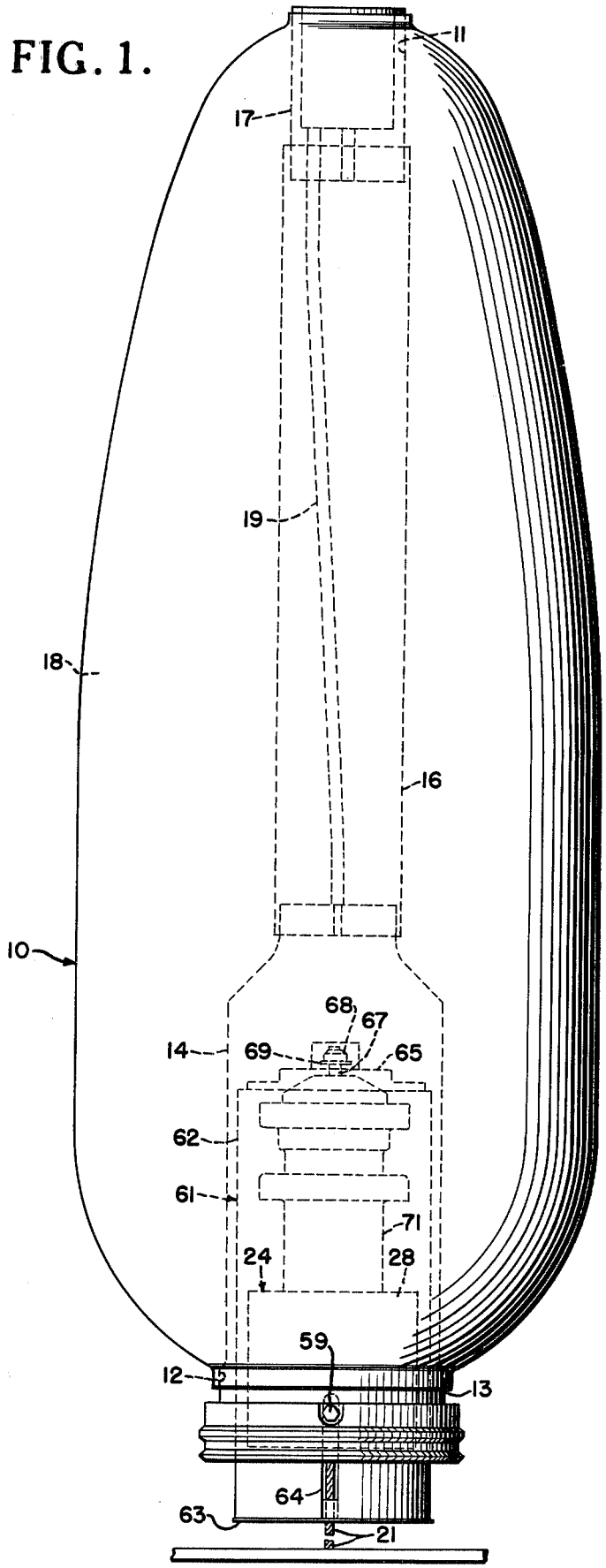
FIG. 1 is a view in elevation of the device of the present invention in accordance with a preferred embodiment thereof.
Figure 7:
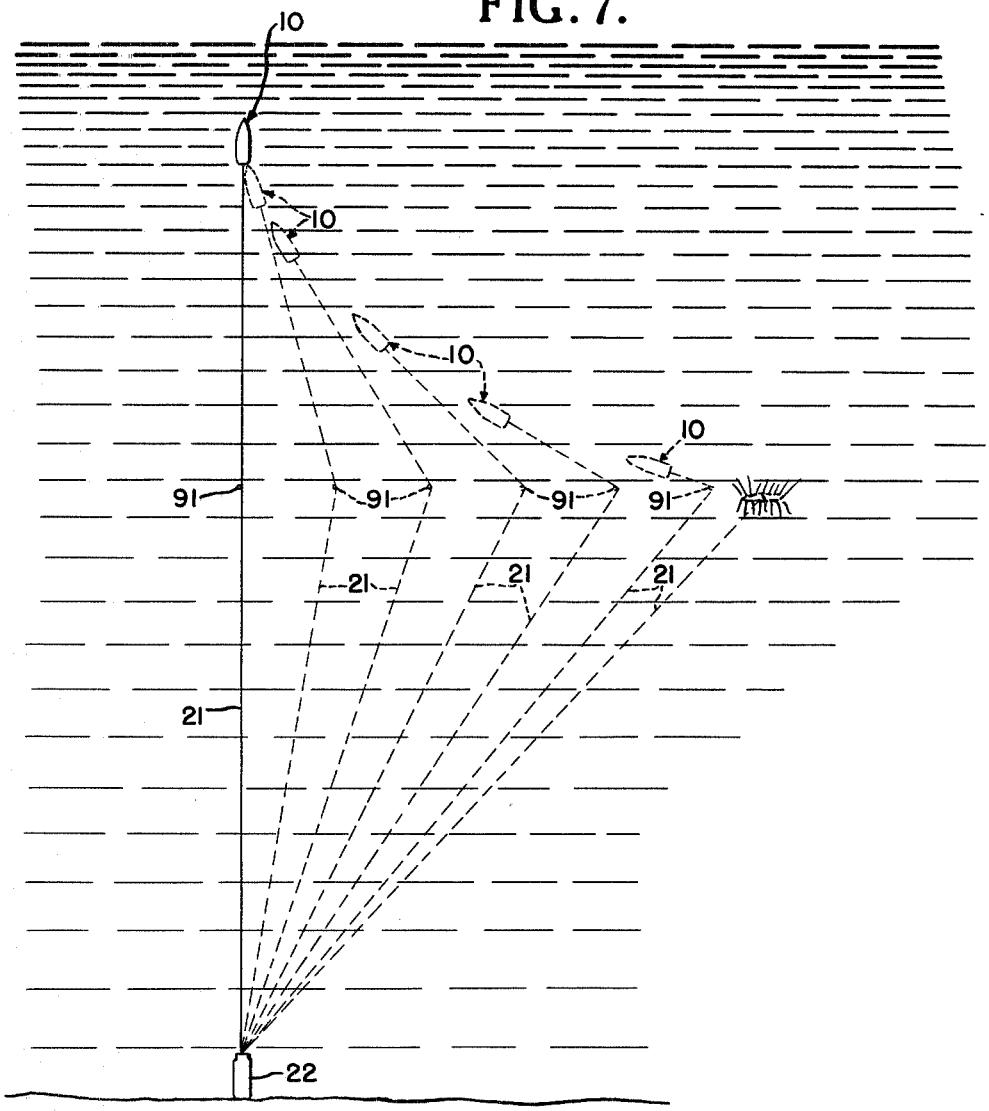
FIG. 7 is a diagrammatic view showing the successive positions assumed by the device when the mooring cable thereof is engaged by a sweep wire.

Referring now to the drawings and more particularly to FIG. 1 thereof, there is shown a float member generally indicated by the reference character 10 and having an opening 11 formed in one end thereof and an enlarged opening 12 arranged in the other end thereof. There is disposed within the opening 12 and secured to the float member as at 13 a cylindrical casing 14 having secured thereto a tubular member 16. Disposed within the opening 11 and secured to the float 10 is in any suitable manner such, for example, as by welding the parts together is a plug 17, one end of the plug being disposed within and secured to the tubular member 16. By the aforesaid arrangement a hermetically sealed chamber 18 is formed within the casing of the float 10. Arranged within and secured to the tubular member 16 and having one end disposed within the plug 17 and the other end thereof disposed within the casing 14 is a tube or pipe 19 for venting the casing 14 as the air therein is displaced by the water upon launching of the device therein. The float 10 is composed of any light weight material suitable for the purpose such, for example, as aluminum or sheet steel whereby sufficient positive buoyancy is obtained when the float is submerged beneath the water to cause the float and the firing mechanism disposed therein to be urged upward against the pull of a mooring cable 21 secured at one end thereof to the anchor 22, FIG. 7, and having the other end secured within a nipple 23, FIG. 2, supported by a shaped charge magazine generally indicated by the numeral 24.

The upper end of the cable 21 has molded thereon an enlarged head 25 composed of any material suitable for the purpose such, for example, as brass or the like. The head is disposed within a socket 26 formed in the member 23 and the cable 21 extends through a bore 27 formed therein and being secured thereto in any suitable manner.

The magazine 24 comprises a cylindrical casing 28 having upper and lower walls 29 and 31 secured thereto preferably by welding the parts together and thus by this arrangement a chamber 32 is formed within the casing 28. The wall 31 is provided with an inwardly extending boss 33 having an end wall 34 formed thereon and a threaded bore 35 formed therein into which is threaded the member 23. Disposed within the chamber 32 in abutting engagement with the casing 28 and wall 31 thereof is an annular member 36.

Arranged within the chamber 32 in spaced relation with respect to the wall 31 is a liner or partition generally indicated by the reference character 37 having a centrally disposed flat surface 38 in abutting engagement with the wall 34 and an annular portion 39 of semi-circular cross sectional configuration extending upwardly therefrom, the outer periphery thereof being in abutting engagement with the member 36. The liner, if desired, may be secured to the wall 34 and annular member 36 in any suitable manner such, for example, as welding the parts together.

A shaped charge 41 is arranged within the casing 28 between the wall 29 and barrier 37 and in accordance with the configuration of the barrier the charge assumes a specific shape having an annular recess therein, the walls of which are of semi-toric configuration. It will be noted however, that an air space 42 is provided between the partition 37 and the wall 31, FIGS. 2 and 3.

Figure 2:
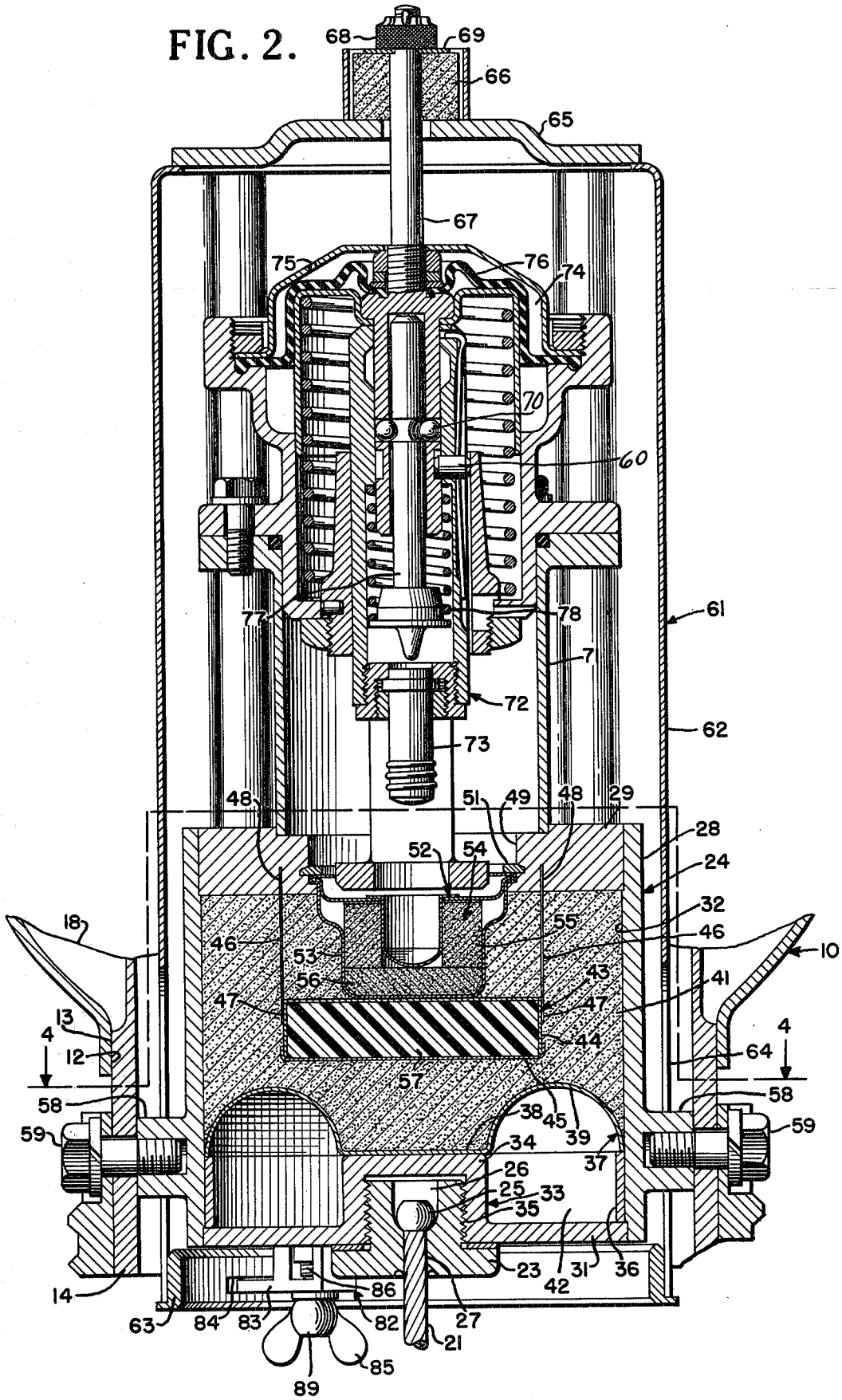
FIG. 2 is an enlarged fragmentary sectional view of the device of FIG. 1 showing the device in an unarmed condition.
Figure 3:
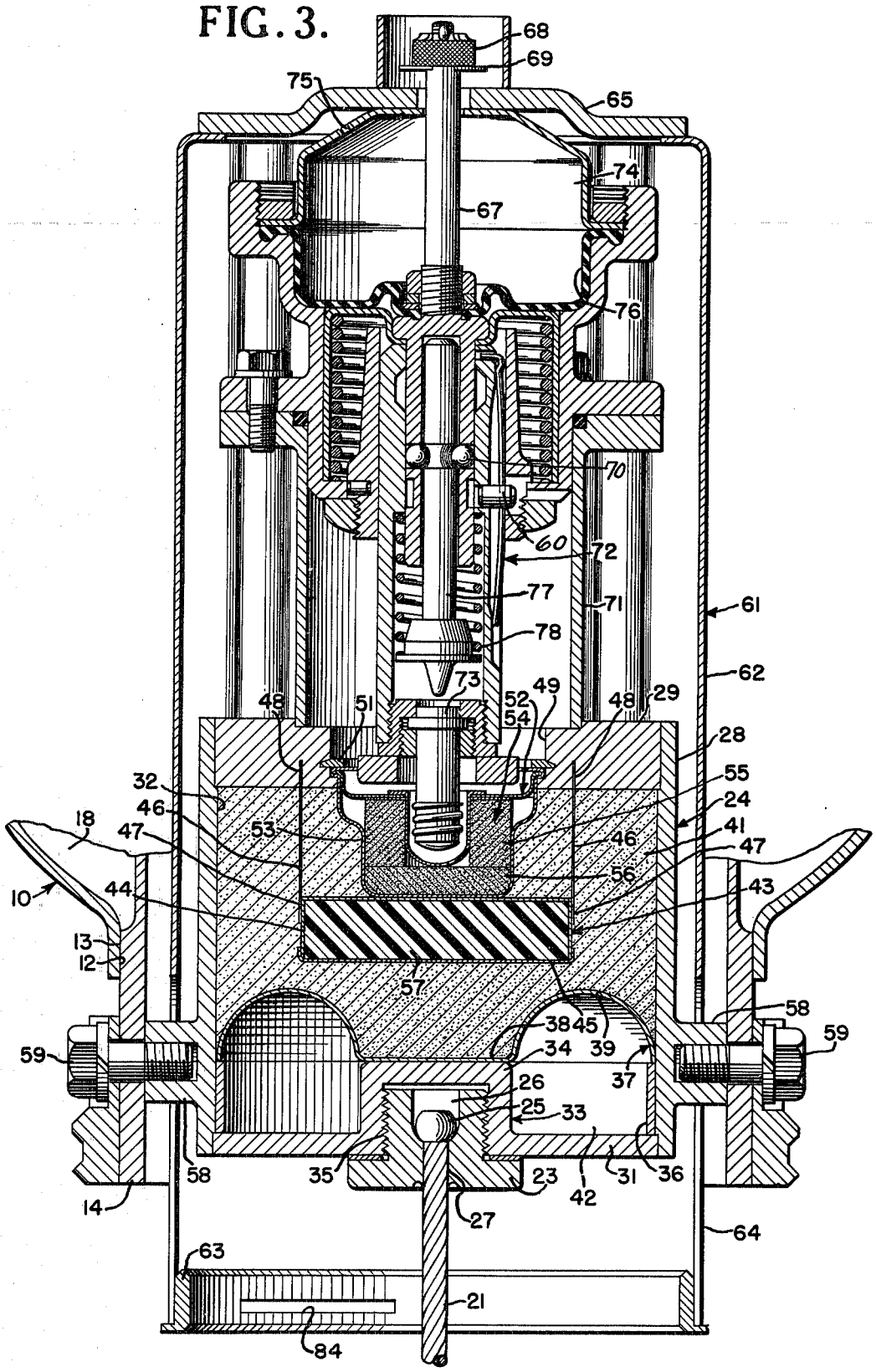
FIG. 3 is a view similar to FIG. 2 with the device in an armed condition.

An inert barrier generally indicated by the reference character 43 is encased within the shaped charge 41 and comprises an inverted cup-shaped member 44 closed by a cover 45, the barrier 43 being supported by rods 46 secured to the cup-shaped member 44 as at 47 and anchored in the wall 29 as at 48, FIGS. 2 and 3.

Disposed within an opening 49 formed in the wall 29 and sealed thereto by a washer 51 is a primer 52, the primer comprising a casing 53 extending into the charge 41 and disposed in abutting engagement with the cup-shaped member 44. An explosive charge 54 composed of any material suitable for the purpose such, for example, as "Tetryl" is arranged within the casing 53 and comprises an annular pellet 55 and a wafer pellet 56.

The barrier 43 has arranged therein a suitable inert material 57 whose shock transmitting velocity is smaller than detonation velocity of the explosive such, for example, as vermiculite, plastic, wood, plaster of paris or any non-explosive material. By this arrangement it will be understood that the shaped charge is fired in response to the firing of the aforesaid pellets 55 and 56. In view of the inert characteristics of the barrier 43 the detonation wave will be directed outwardly and downwardly and thus in accordance with the specific configuration of the shaped charge a circular shaped jet is developed which is directed around and into engagement with the sweep wire whereupon the sweep wire is severed at two points in response to the force of the explosion exerted thereon.

As most clearly shown on FIGS. 2 and 3 the casing 28 is secured to the tubular member 14 by a plurality of lugs 58 and bolts 59, the lugs also being adapted to slideably support an actuating device generally indicated by the reference character 61 and comprising a casing 62 having an annular sweep wire engaging member 63 secured to one end and a yoke 65 secured to the other end thereof. The lugs 58 are respectively arranged in a plurality of elongated slots 64 formed in the casing 62 whereupon the casing may be moved a predetermined amount by the sweep wire as the sweep wire engages and moves along the mooring cable 21 and into engagement with the sweep wire engaging member 63.

Disposed within the container 14 and arranged in abutting engagement with the yoke 65 is a soluble washer 66 composed of any material suitable for the purpose such, for example, as a composition of salt, glycerine and glue, and having a bore therethrough in which is arranged a slideable plunger member or shaft 67 having a nut 68 threaded on the upper end thereof. A washer 69 is arranged on shaft 67 in registered engagement with a shoulder formed thereon and arranged between the nut 68 and the soluble washer whereupon movement of the slideable member 67 is prevented until the device has been submerged within a body of water for a period of time sufficient to cause the soluble washer to dissolve or soften sufficiently to permit movement of the plunger member 67.

A casing 71 is secured to the wall 29 in any suitable manner such, for example, as by welding the parts together. Disposed within the casing 71 is a suitable hydrostatically controlled arming and firing mechanism similar to the device shown and claimed in the copending application of Joseph D. Turley, Ser. No. 432,455, entitled Means for Destroying a Sweep Wire, filed Feb. 26, 1942, now U.S. Pat. No. 2,764,090, and indicated generally by the numeral 72.

Referring to FIG. 2 of the drawings the device is shown in unarmed condition with the detonator 73 withdrawn from the primer 52 whereupon premature detonation of the primer is prevented, however, when the device has been launched in a body of water the soluble washer will dissolve, when a predetermined period of time has elapsed. As the water enters chamber 74 by way of aperture 75 the pressure of the water against the flexible diaphragm 76 causes the plunger 67 to be moved downwardly a predetermined amount whereupon the detonator 73 is moved into operative relation with respect to the primer 52, and the device 72 is now locked by a spring loaded pin 60 which moves into a hole in the sleeve in which it slides and is in an armed condition as shown on FIG. 3.

While the casing 62 of the actuating device 61 may initially move downwardly a given amount it cannot move a sufficient distance to advance the detonator to a locked position until after the soluble washer dissolves. The detonator 73 is actuated to an armed position during the subsequent movement of plunger 67. The casing 62 of the actuating device 61 projects downwardly a predetermined amount whereupon the sweep wire engaging member 63 thereon is in a position to be engaged and actuated by the sweep wire thereby to cause release of the firing pin 77. This firing occurs with engagement by a sweep wire of the member 63 which lifts the casing 62 and effects a lifting of the washer 69 therewith. This action also lifts the slidable plunger shaft 67 and the nut 68 and raises the shaft 77 which is initially locked with plunger shaft 67 by a plurality of balls 70 disposed in holes in plunger 67 and a groove in shaft 77. As these balls move upwardly with shaft 67 they move into alignment with an annular groove in the locked sleeve portion of firing mechanism 72 and effect a release of shaft 77 which is driven into the detonator 73 by spring 78. When this occurs the firing pin is forcibly driven into firing engagement with the detonator 73 by the spring 78. It is to be understood that the details of the firing pin release mechanism and the hydrostatic arming mechanism form no part of the instant invention.

Figure 4:
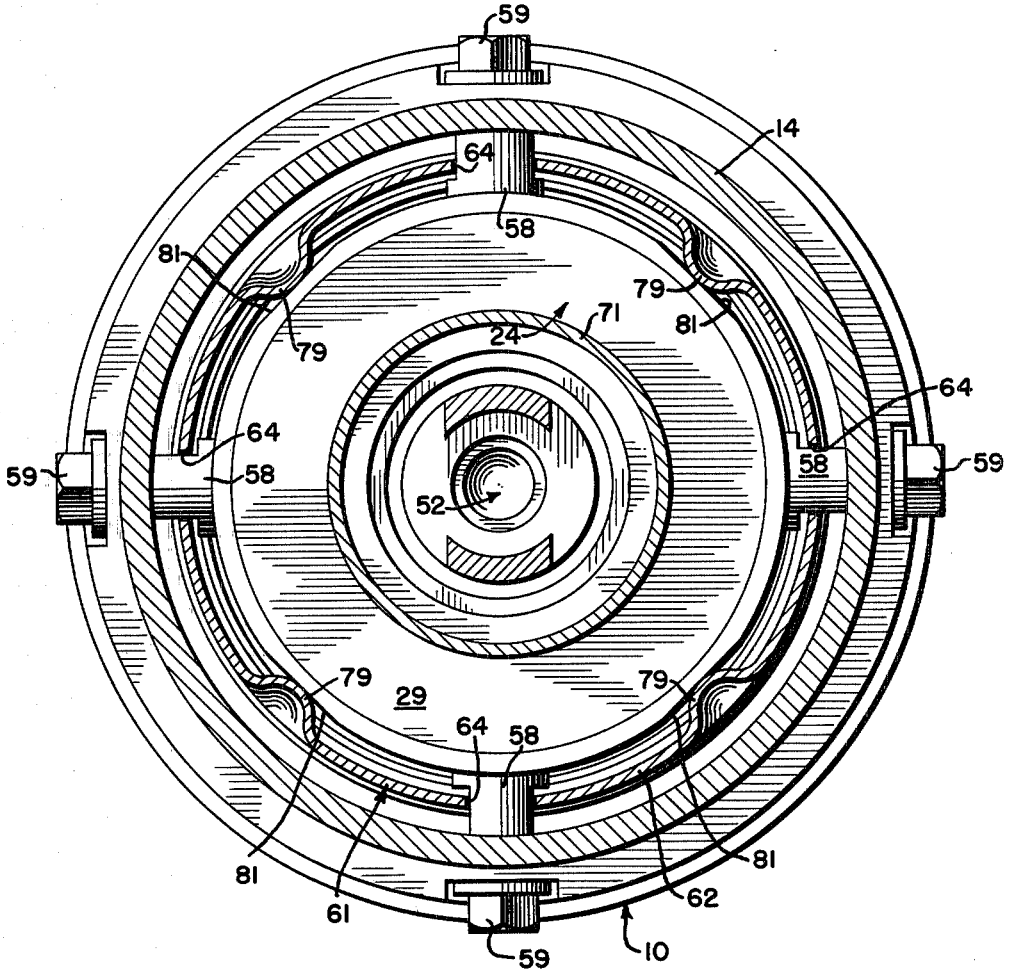
FIG. 4 is a sectional view taken on the line 4—4 of FIG. 2.

As more clearly shown in FIG. 4 the casing 62 is provided with a plurality of ribs 79 formed therewith and depressed inwardly therefrom into engagement with a plurality of flat surfaces 81 respectively formed on the magazine casing 28. By this arrangement with the greater portions of casings 28 and 62 out of engagement with respect to each other the friction is reduced to a minimum and thus the casing 62 may be readily moved to the position shown in FIG. 3 as the shaft 67 is moved in response to movement of the diaphragm and the washer 69 thereon engages the yoke 65 on the casing 62.

Figure 5:
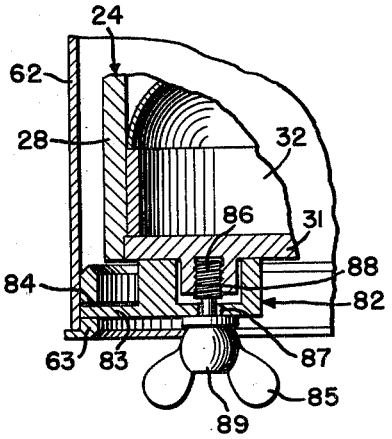
FIG. 5 is a fragmentary view in section showing means for locking the movable member during assembly of the device within the float member.

The device is provided with a safety device comprising a member 82 having a tongue or lip 83 formed thereon and disposed within a slot 84 formed in the sweep wire engaging member 63. A screw 85 comprising a threaded stem 86 is threaded through a bore 87 formed in the member 82 and into threaded engagement with a socket 88 formed in the wall 31, the screw having an enlarged head 89 thereon in abutting engagement with the member 82 and thus the actuating member 61 is locked to the casing 28 thereby preventing movement of the member 61 and firing ring 63 thereon downward until the screw 85 is removed prior to launching the device within a body of water. It will be understood, however, that by employing the aforesaid locking device the plunger 67 is effectively prevented from being moved to an armed position while the screw and locking member is in the assembled position shown in FIG. 5, and thus the device is rendered safe during handling and transportation.

Figure 6:
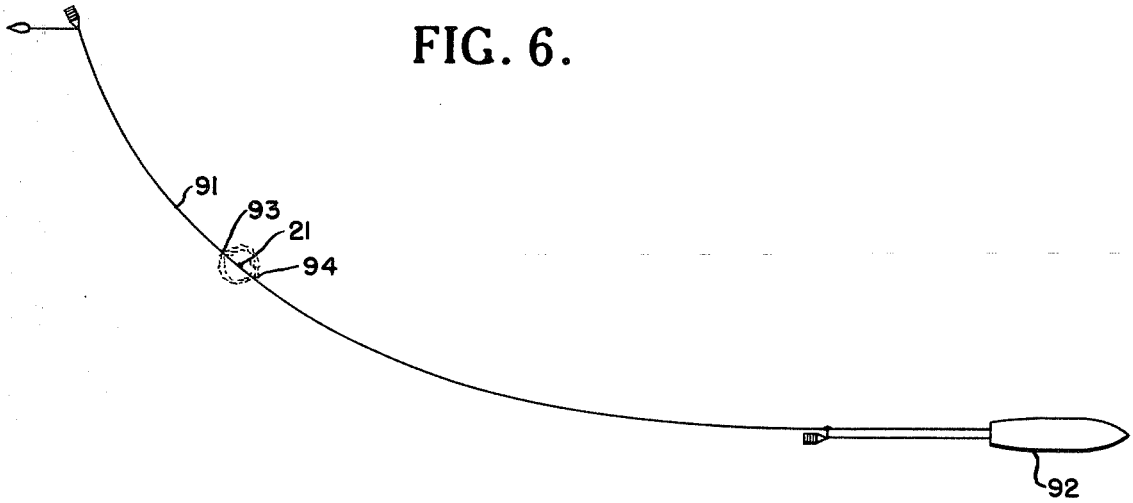
FIG. 6 is a diagrammatic view of a sweep wire and the towing arrangement therefore.

In operation it will be understood that when the mooring cable 21 is engaged by the sweep wire such, for example, as the sweep wire 91 being towed through the water by a vessel or mine sweeper 92, FIG. 6. As the mooring cable moves along the sweep wire in response to the forward movement of the vessel, the float 10 is moved toward the sweep wire, FIG. 7, until the sweep wire engages the firing ring 63. As the sweep wire engages and moves the firing member 63 a predetermined amount the firing mechanism is actuated to a release position whereupon the firing pin is forcibly driven into firing engagement with the detonator 73 and thus the detonator is fired which in turn fires the primer 52. When this occurs the shaped charge 41 is fired by the primer 52 and a circular jet is developed thereby which encircles the mooring cable as indicated by the dashed line in FIG. 6, whereupon the sweep wire is severed at two points 93 and 94 in response to the force of the explosive jet directed thereagainst.

Briefly stated in summary, the present invention provides a new and improved device for destroying a sweep wire in which an inert barrier is encased in a special shaped explosive charge thereby to shape the detonation wave as the charge is exploded whereupon sufficient force therefrom is applied to the sweep wire to effect cutting of the sweep wire and in which means including a pressure responsive device controlled by the pressure of water is employed for arming the device in response to a predetermined pressure applied thereto and in which means actuated by the sweep wire are adapted to cause the charge to be fired as the sweep wire is brought into engagement therewith and moves a predetermined amount thereby.

Obviously many modifications and variations of the present invention are possible in the light of the above teachings. It is therefore to be understood that within the scope of the appended claims the invention may be practiced otherwise than as specifically described.

The invention described herein may be manufactured and used by or for the Government of the United States of America for governmental purposes without the payment of any royalties thereon or therefor.

What is claimed as new and desired to be secured by Letters Patent of the United States is:

1. A sweep wire destroying device of the character disclosed comprising a buoyant member adapted to cause the device to float within a body of water, means including a cable for mooring the device within the water, a movable annular member disposed about said cable for engagement by a sweep wire, a tubular member on said device for slideably supporting said annular member, a shaped charge disposed within the device in adjacency to said annular member, means including a liner forming a toroidal air chamber abutting the lower surface of said charge, means including a primer controlled by said annular member for firing said shaped charge when the annular member is engaged by said sweep wire, and means including an inert mass arranged within said charge intermediate the primer and said liner for (initially controlling the application of force of the explosion in such manner that the explosive wave is applied uniformly and symmetrically to the toroidal surface of said liner as the shaped charge is fired thereby to sever said sweep wire.

2. In a moored weapon of the character disclosed comprising a buoyant casing, a chamber within said casing having an aperture in the lower portion thereof through which water is adapted to flow, means including a cable secured to said casing for mooring the weapon, a shaped charge disposed within said weapon in substantial alignment and closely spaced adjacency to an end portion of said cable, a spring actuated firing pin for exploding said shaped charge, means controlled by the pressure of water within said chamber for moving the firing pin to a predetermined armed position, means including a movable member disposed around said cable and operatively connected to said firing pin for causing the shaped charge to be fired by said firing pin as the movable member is engaged by a sweep wire, said movable member being disposed proximately with respect to the shaped charge, and detonation wave shaping means including an inert mass disposed within said charge intermediate the firing pin and said aperture for shaping and controlling the force of the explosion as the shaped charge is fired thereby to sever said sweep wire.

3. In a device of the character described comprising a buoyant casing, a chamber within said casing having an aperture in the lower portion thereof through which water is adapted to flow, a shaped charge arranged within said device, a firing mechanism including a spring actuated firing pin and a primer for exploding said shaped charge, means controlled by the pressure of the water within said chamber for moving the firing mechanism to a predetermined armed position, means including a cable secured to said casing for mooring the device within the water, a cylindrical member movably supported on said device, a sweep wire engaging member on said cylindrical member operatively connected to said firing pin and movable by a sweep wire for causing said shaped charge to be fired in adjacency thereto by said firing pin, means including a liner forming a toroidal air chamber abutting the lower surface of said charge, and a cylindrical inert mass for providing a barrier disposed within the shaped charge intermediate the firing pin and said liner, said liner shaping and controlling the detonation wave as the charge is fired thereby to focus the explosive blast to a downwardly extending annular jet of sufficient strength to effect cutting of said sweep wire.

4. In a device of the character disclosed arranged within a body of water at a predetermined depth of submersion, a buoyant member for causing the device to float within the water, means including a cable for mooring said device means including a hydrostat for arming the device when a predetermined period of time has elapsed after the device has been planted within the body of water, detonating means, a spring actuated firing pin releasably supported in proximate relation to said detonating means, a movable member disposed about said cable and including a tubular member slideably supported on said device, means operatively connected to said movable member and effective when said movable member has been engaged by a sweep wire for causing the detonating means to be fired by said firing pin, a shaped charge disposed in said device in proximate relation to said movable member and fired by said detonating means, means including a liner forming a toroidal air chamber abutting the lower surface of said charge, and means including an inert mass of sufficient magnitude for providing a barrier within said shaped charge disposed intermediate the detonating means and said liner for causing a detonation wave to be directed and localized against said liner uniformly and symmetrically as the shaped charge is fired thereby to focus the explosive blast to a downwardly extending annular jet of sufficient strength to sever the sweep wire.

5. In a device of the character described for destroying a sweep wire, the combination of a moored float having a chamber therein in communication with the water, means for mooring the float within said water, a detonating device, an explosive device, a firing device, means controlled by the pressure of the water within the chamber for moving said detonating device into operative relation with said explosive device, means for firing said explosive device, means including a cylindrical member slideably carried by said float and effective when a sweep wire has engaged said mooring means and moved into contact with said firing device for causing the explosive device to be fired by said firing means, a shaped charge supported within said device superjacent said mooring means, means including a semi-toric member for supporting said shaped charge within said device and for providing an annular air chamber subjacent thereto, and a circular inert mass of sufficient magnitude to provide a barrier within said shaped charge intermediate said firing device and the air chamber for causing a controlled detonation wave to be directed uniformly and symmetrically against said semi-toric member as said shaped charge is fired in a manner to focus the explosive blast to a downwardly extending annular jet of sufficient force to sever the sweep wire at a plurality of locations.

6. In a device of the character described for destroying a sweep wire, the combination of a moored float adapted to cause the device to float within a body of water, cable means for mooring the device within the water, means including a movable annular member disposed about said cable for engagement by a sweep wire, a shaped charge disposed within said device in adjacency to said annular member, and means controlled by said annular member for firing said shaped charge when the annular member is engaged by said sweep wire, means including a semi-toric liner for providing an annular air chamber in subjacent abutting relation with said charge thereby to focus the explosive blast of the charge through the water into a cylindrical configuration of sufficient strength to sever the sweep wire, and a circular inert mass disposed within the charge intermediate said firing means and the liner for causing the explosive wave within the charge to impinge uniformly on the top part of said liner.

7. In a device of the character described for destroying a sweep wire, the combination of a moored float adapted to cause the device to float within a body of water, a cable for mooring the device within the water, means including a movable annular member disposed about said cable for engagement by a sweep wire, a shaped charge supported within said device, means for firing said charge a liner of semi-toric configuration arranged within said device for shaping and supporting the charge therein, means comprising said liner forming an annular air chamber encircling an end portion of said cable for causing the pressure wave of the explosion to be focused downwardly through the water with a cylindrical configuration, and a circular inertial mass arranged within said charge intermediate said firing means and the liner for causing the explosive wave within the charge to impinge the upper surface of said liner uniformly and symmetrically.

* * * * *